United States Patent [19]

Pullen

[11] Patent Number: 4,554,408

[45] Date of Patent: Nov. 19, 1985

[54] CABLE OUTLET ADAPTORS

[75] Inventor: Roger J. Pullen, Bogner Regis, England

[73] Assignee: Schlumberger Electronics (U.K.) Limited, Farnborough, England

[21] Appl. No.: 573,183

[22] Filed: Jan. 23, 1984

[30] Foreign Application Priority Data

Jan. 28, 1983 [GB] United Kingdom ..... 8302404

[51] Int. Cl.[4] ..... H01R 13/56; H01R 13/58

[52] U.S. Cl. ..... 174/135; 339/101

[58] Field of Search ..... 174/46, 74 A, 81, 135, 174/153 G; 339/58, 101, 102 R, 103 R, 103 B, 103 C, 103 M, 107

[56] References Cited

U.S. PATENT DOCUMENTS 2,536,996 1/1951 Holland et al. ..... 174/46

3,809,798 5/1974 Simon ..... 174/135

FOREIGN PATENT DOCUMENTS

WO82/03296 9/1982 PCT Int'l Appl. ..... 339/103 M

*Primary Examiner*—Laramie E. Askin

*Attorney, Agent, or Firm*—Dale Gaudier

[57] ABSTRACT

A cable outlet adaptor comprises (i) a bush (20) which is threaded over the cable (14) and has a cut-out (30) towards one end; and (ii) a hood (40), having a cap portion (42) and a sleeve portion (44) at a right angle thereto, and split into two sections along a median plane through both portions. The hood can be fitted, even when the cable is already terminated at both ends, by displacing the cable into the cut-out in the bush, placing the cable and bush in one half of the hood and folding the other half over so that the bush extends into the cap portion and the cable emerges from the cut-out into the sleeve portion. A spiral support spring (60) slides over the sleeve portion to hold the two halves togehter, and pegs (48) in the cap portion engage in holes (32) in the bush to retain the hood on the bush.

8 Claims, 9 Drawing Figures

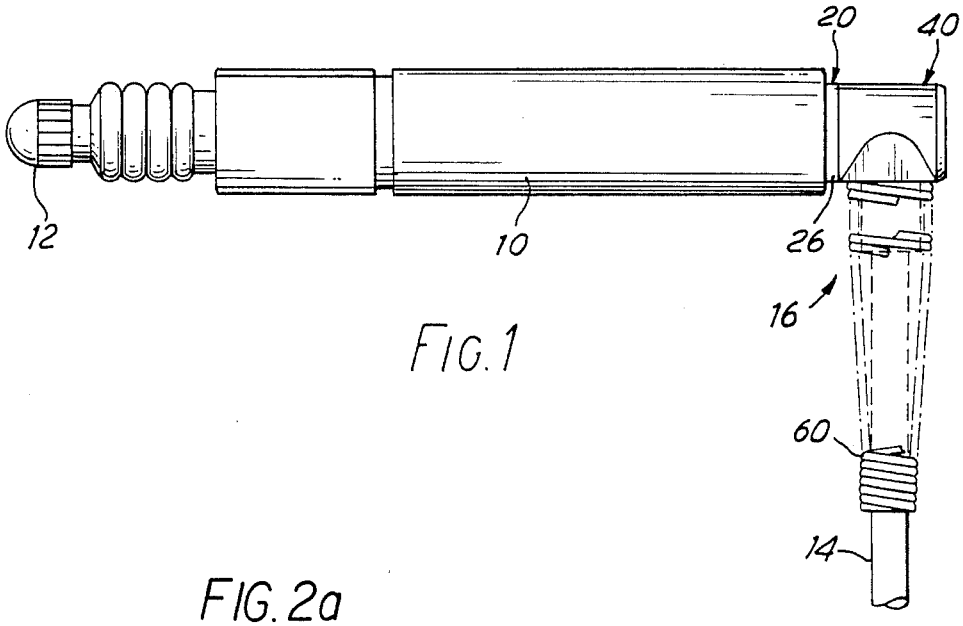
FIG. 1
FIG. 2a
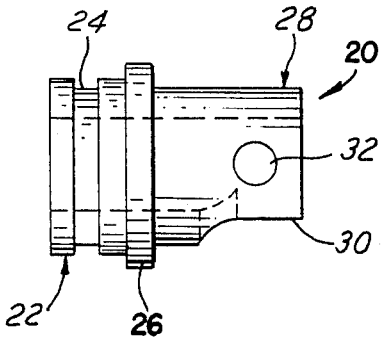
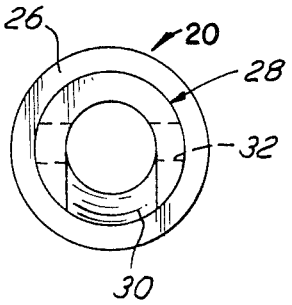
FIG. 2c
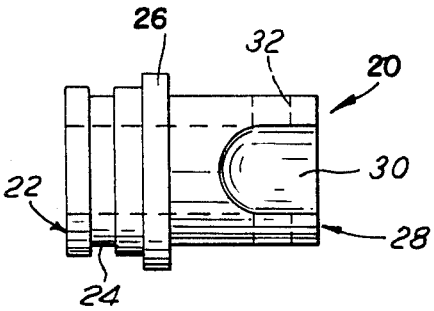
FIG. 2b

FIG. 3c
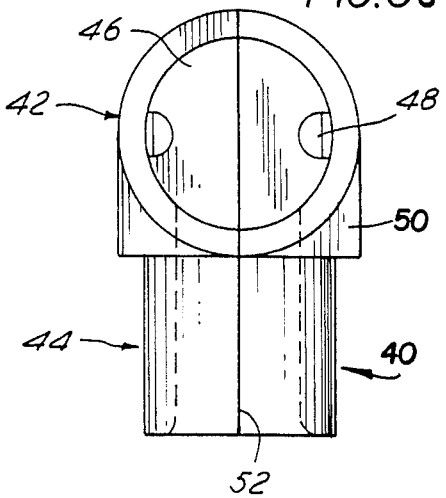
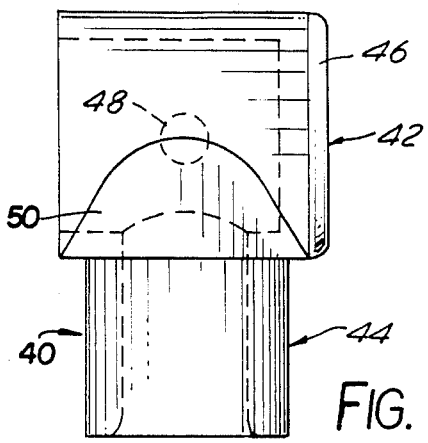
FIG. 3a
FIG. 3b
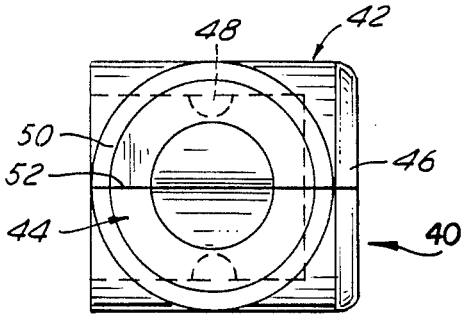
FIG. 4a
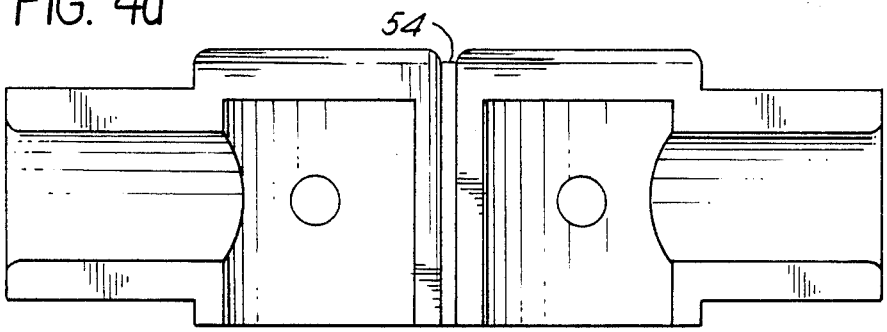
FIG. 4b
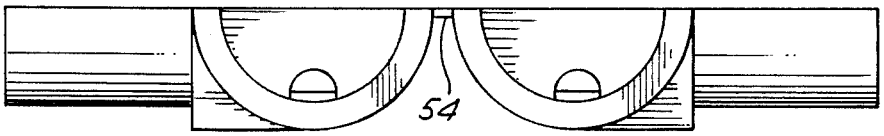

CABLE OUTLET ADAPTORS

BACKGROUND OF THE INVENTION

This invention relates to cable outlet adaptors, for example for providing support and strain relief at the point where a cable passes out of a housing.

It is an object of this invention to provide a cable outlet adaptor which can be converted from an in-line configuration (in which the cable extends both through and away from the housing along generally the same line) to a right-angle configuration (in which the cable extends through the housing substantially at a right angle to the line along which it extends away from the housing), or vice-versa, even though the cable is already terminated at both ends to other devices.

SUMMARY OF THE INVENTION

According to one aspect of this invention there is provided a cable outlet adaptor comprising: (i) a hollow bush through which a cable can extend and having an end portion with a cut-out in one side, and (ii) a hollow hood having a cap portion arranged to be positioned around said end portion of said bush, and a sleeve portion extending from the cap portion at an angle thereto, the hood being split into two sections along a common median plane of the cap and sleeve portions, whereby the hood can be installed with the cable in situ in the bush (for example to form an angled outlet from an in-line outlet) by displacing the cable to extend through the cut-out in the bush and placing the two sections of the hood around the cable and the bush, so that said end portion of the bush lies in said cap portion and the cable extending from said cut-out lies in said sleeve portion.

BRIEF DESCRIPTION OF THE DRAWINGS

A cable outlet adaptor in accordance with this invention for use with an inductive displacement transducer will now be described, by way of example, with reference to the accompanying drawings, in which:

FIG. 1 is a side view of an inductive displacement transducer fitted with the adaptor in its right-angle configuration;

FIGS. *2a, b,* and *c* are side bottom and end views respectively of a bush forming part of the adaptor;

FIGS. *3a, b* and *c* are side, bottom and end views respectively of a hood also forming part of the adaptor;

FIGS. *4a* and *b* are side and end views respectively of the hood as formed by blow moulding.

DESCRIPTION OF THE PREFERRED EMBODIMENT

Referring to FIG. 1, there is shown an inductive displacement transducer for measuring such quantities as positions, dimensions and motions. The transducer comprises a cylindrical body 10 carrying a movable probe 12 projecting from one end of the body 10. The probe 12 is connected within the body 10 to a magnetic core (not shown) within an array of coils (also not shown) by means of which the position and motion of the core, and thus of the probe 12, can be sensed. The construction and operation of such a transducer, shown here merely by way of illustration, form no part of this invention, and thus need not be discussed further.

A cable 14 extends from the end of the body 10 remote from the probe 12, via an outlet adaptor indicated generally at 16. As shown, the adaptor 16 is a right-angle adaptor, that is the cable 14 extends away from the body 10 substantially at a right angle to the direction in which it extends out of the end of the body 10. The adaptor 16 comprises three components: a bush 20, a hood 40 and a spiral support spring 60.

Referring to FIGS. *2a* to *2c*, the bush 20 is hollow and generally cylindrical in form, and made from glass-filled nylon. Adjacent one end 22, which is dimensioned to fit within the body 10, there is a cicumferential recess 24 to assist in retention of the bush 20 within the body 10 (for example, in combination with an epoxy adhesive, circlip or grub screw). A collar 26 extends around the bush 20 to divide the end 22 from the other end 28 which protrudes from the body 10 when the bush is in position. This other end 28 has a U-shaped cut-out 30 extending from the end surface thereof, and, a short distance in from the end surface, two diametrically-opposed radial holes 32 lying in the median plane of the bush that is parallel to the cut-out 30.

Referring now to FIGS. *3a* to *3c*, the hood 40 is hollow and has two generally cylindrical portions 42 and 44 at right angles to one another. The portion 42 forms a cap, closed at one end by a wall 46, to enclose the end 28 of the bush 20, and its internal diameter and length are chosen to fit over that end 28. Two diametrically-opposed hemispherical pegs 48 protrude from the inner surface of the cap portion 42, on a median plane thereof that is transverse to the axis of the portion 44.

This other portion 44 forms a sleeve for the cable 14. Its external diameter is preferably the same as the external diameter of the end 28 of the bush 20. Where the sleeve portion 44 meets the cap portion 42, its diameter is enlarged as at 50.

The hood 40 is split into two symmetrical halves along a median plane 52 containing the axes of both the cap portion 42 and the sleeve portion 44, and the two halves are hinged together along the top of the cap portion 42, that is opposite the sleeve portion 44. The hood 40 can conveniently be moulded as a single piece, from polypropylene, the two halves being joined by a narrow, thin fillet 54 of this material to form a hinge, as shown in FIGS. *4a* and *b*.

When the cable outlet is to be assembled, the bush 20 and the spiral support spring 60 are threaded onto the cable 14, either before or after this has been connected to the coils of the inductive displacement transducer. The bush 20 is then secured in the end of the body 10 of the transducer, and the cable 14 led sideways out of the bush 20, via the cut-out 30. The bush 20 and cable 14 are placed in one half of the split hood 40, and the other half folded over so that the cap portion 42 encloses the end 28 of the bush 20, with the pegs 48 engaging in the holes 32, and so that the sleeve portion 44 embraces the cable 14 where it emerges from the cut-out 30. Finally, the two halves of the hood 40 are squeezed together, and the spiral support spring 60 is slid over the sleeve portion 44. Thus the spring 60 retains the two halves of the hood 40 together, and the hood 40 is in turn retained on the bush 20 by the pegs 48 engaging in the holes 32. Alternatively, pegs 48 could be provided on bush 20 and holes 32 formed in hood 40 to provide the same retention function.

The arrangement described provides a simple, cheap right-angle outlet for a cable. Furthermore, the hood 40 can be fitted to the cable 14 even after both ends of the cable 14 have been terminated (for example, to the transducer coils and to a plug.) Thus, the cable 14 could initially be installed in in-line configuration, extending straight out from the bush 20, with the support spring 60 directly over the end 28 of the bush 20 (this end 28 being, as noted above, the same diameter as the sleeve portion 44 of the hood 40). Thereafter, it can readily be converted to a right-angle configuration by sliding the support spring 60 off the bush 20, displacing the cable 14 into the cut-out 30, placing the hood 40 over the bush 20 and cable 14 as described above, and sliding the support spring 60 back up the cable 14 on to the sleeve portion 44 to complete the assembly. Equally, a right-angle connection can be converted to in-line by reversing this procedure to remove the hood 40.

It will be understood that the hood 40 shown and described could be modifified to provide for cable outlets at other angles than a right-angle.

I claim:

1. A cable outlet adaptor comprising: (i) a hollow bush through which a cable can extend longitudinally and having an end portion with a cut-out in one side, and (ii) a separate hollow hood having a cap portion arranged to be positioned around said end portion of said bush, and a sleeve portion extending from the cap portion at an angle thereto, the hood being separable into two sections along a common median plane of the cap and sleeve portions, whereby the hood can be installed with the cable in situ in the bush by displaceing the cable to extend through the cut-out in the bush and placing the two sections of the hood around the cable and the bush, so that said end portion of the bush lies in said cap portion and the cable extending from said cut-out lies in said sleeve portion.

2. A cable outlet adaptor according to claim 1, wherein said sleeve portion of said hood extends at a right-angle to said cap portion.

3. A cable outlet adaptor according to claim 1, wherein the two sections of said hood are hinged together.

4. A cable outlet adaptor according to claim 3, wherein said hinge extends along said cap portion opposite said sleeve portion.

5. A cable outlet adaptor according to claim 3, wherein said two sections of said hood are hinged together by a fillet of the same material as said hood and integral therewith.

6. A cable outlet adaptor according to claim 1, wherein one of said bush and said hood carries at least one peg protruding therefrom, and the other of said bush and said hood has a co-operating hole to receive the peg, when the hood is placed around the bush, and retain the hood thereon.

7. A cable outlet adaptor according to claim 1, including a spiral support spring arranged to fit over said sleeve portion of said hood to retain said two sections thereof together.

8. A cable outlet adaptor according to claim 7, wherein said end portion of said bush has the same external diameter as said sleeve portion of said hood.

* * * * *